US008018170B2

(12) United States Patent
Chen et al.

(10) Patent No.: US 8,018,170 B2
(45) Date of Patent: Sep. 13, 2011

(54) LIGHT EMITTING DIODE DRIVING MODULE

(75) Inventors: Ke-Horng Chen, Taipei County (TW); Chia-Lin Chiu, Taoyuan County (TW); Lan-Shan Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 537 days.

(21) Appl. No.: 12/147,492

(22) Filed: Jun. 27, 2008

(65) Prior Publication Data

US 2009/0261743 A1 Oct. 22, 2009

(30) Foreign Application Priority Data

Apr. 18, 2008 (TW) ..... 97114262 A

(51) Int. Cl.
*H05B 37/00* (2006.01)

(52) U.S. Cl. ..... 315/192; 315/185 R; 315/291; 315/307

(58) Field of Classification Search ..... 315/209 R, 315/224, 225, 291, 307, 312, 361, 185 R, 315/186, 192
See application file for complete search history.

(56) References Cited

U.S. PATENT DOCUMENTS

| | | | | |
|---|---|---|---|---|
| 7,733,034 | B2 * | 6/2010 | Kotikalapoodi et al. | 315/294 |
| 7,843,150 | B2 * | 11/2010 | Wang et al. | 315/307 |
| 2007/0114951 | A1 * | 5/2007 | Tsen et al. | 315/291 |
| 2008/0061716 | A1 * | 3/2008 | Kim et al. | 315/307 |
| 2009/0167197 | A1 * | 7/2009 | Wang et al. | 315/185 R |
| 2009/0230891 | A1 * | 9/2009 | Zhao et al. | 315/308 |

* cited by examiner

*Primary Examiner* — Jacob Y Choi
*Assistant Examiner* — Jimmy T Vu
(74) *Attorney, Agent, or Firm* — Jianq Chyun IP Office

(57) ABSTRACT

An LED driving module suitable to drive a plurality of LED strings in parallel connection is disclosed. The LED driving module includes a voltage converting apparatus, a conduction voltage detecting apparatus, a reference voltage generating apparatus and a current-adjusting apparatus. The voltage converting apparatus produces a driving voltage according to a conduction voltage. The conduction voltage detecting apparatus detects the conducting states of the LED strings for producing a conduction voltage and an enabling signal. The reference voltage generating apparatus generates a first reference voltage according to the enabling signal. The current-adjusting apparatus produces a plurality of driving currents according to the first reference voltage, and the driving currents flow through the LED strings.

17 Claims, 6 Drawing Sheets

LIGHT EMITTING DIODE DRIVING MODULE

CROSS-REFERENCE TO RELATED APPLICATION

This application claims the priority benefit of Taiwan application serial no. 97114262, filed on Apr. 18, 2008. The entirety of the above-mentioned patent application is hereby incorporated by reference herein and made a part of specification.

BACKGROUND OF THE INVENTION

1. Field of the Invention

The present invention generally relates to a light emitting diode module (LED module), and more particularly, to a driving module for driving an LED.

2. Description of Related Art

Due to low power consumption and high luminance, LEDs have been effectively applied in various applications, for example, illumination light, electronic bulletin board and traffic light. In particular, in display field, LEDs have excellent color performance within the gamut set out by National Television Standard Committee (NTSC); therefore, LEDs are gradually substituting a cold cathode fluorescent lamps (CCFL) employed by a backlight module of a display panel and the CCFL is a dominated light source used in a backlight module before.

However, the LEDs served as the light source of a backlight module of a display panel confront two stubborn problems. One of the problems is how to make a plurality of light emitting diode strings (LED strings) in a backlight module produce uniform luminance so as to have better display effect with a display panel. The luminance produced by an LED string is controlled by the current flowing through the LED string. Once only a fixed voltage is used to drive different LED strings, the characteristic difference between individual LED strings would result in nonuniform luminance as a whole.

To solve the above-mentioned problem, many different conventional schemes were provided. One of the conventional schemes is to utilize a plurality of sets of voltage-to-current converters for individually adjusting luminance of each of the LED strings. Although the above-mentioned scheme is able to individually adjust luminance of each of the LED strings to effectively overcome the problem resulted by the characteristic difference between the LED strings, but the conventional scheme requires a numerous voltage-to-current converters, which is not economical solution. Moreover in the prior art, there is time-division-multiplexing (TDM) scheme, by which the luminance corresponding to different LED string is adjustable to achieve balance of luminance. The conventional TDM scheme requires a clock signal with a high frequency and a plurality of switching signals produced based on the clock signal for switching a plurality of switches. The frequent switching of the switches tends to produce inrush currents leading to serious electromagnetic interference (EMI).

SUMMARY OF THE INVENTION

Accordingly, the present invention is directed to an LED driving module for dynamically adjusting the voltage and current of driving an LED string so as to thereby increase the light-emitting efficiency and luminance uniformity of the LED strings.

The present invention provides an LED driving module suitable to drive a plurality of LED strings in parallel connection. Each of the LED strings herein has a first terminal and a second terminal. The LED driving module includes a voltage converting apparatus, a conduction voltage detecting apparatus, a reference voltage generating apparatus and a current-adjusting apparatus. The voltage converting apparatus produces a driving voltage at the first terminal of each the LED string according to a conduction voltage. The conduction voltage detecting apparatus is coupled to the second terminal of each the LED string for detecting the conducting states of the LED strings and thereby producing the above-mentioned conduction voltage and a plurality of enabling signals. The reference voltage generating apparatus generates a first reference voltage according to the above-mentioned enabling signals. In addition, the current-adjusting apparatus produces a plurality of driving currents respectively flowing through each the LED string according to the first reference voltage.

Since the present invention adopts a conduction voltage detecting apparatus for detecting the minimal voltage required by the LED strings and thereby providing the most effective driving voltage. The present invention further employs a current-adjusting apparatus for adjusting the driving currents provided to the LED strings so as to stabilize the entire luminance of LED strings. Moreover, the present invention uses a current-balancing device for reducing the differences of the driving currents between the LED strings, which further ensures the luminance uniformity of the LED strings.

BRIEF DESCRIPTION OF THE DRAWINGS

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

Figure 1:
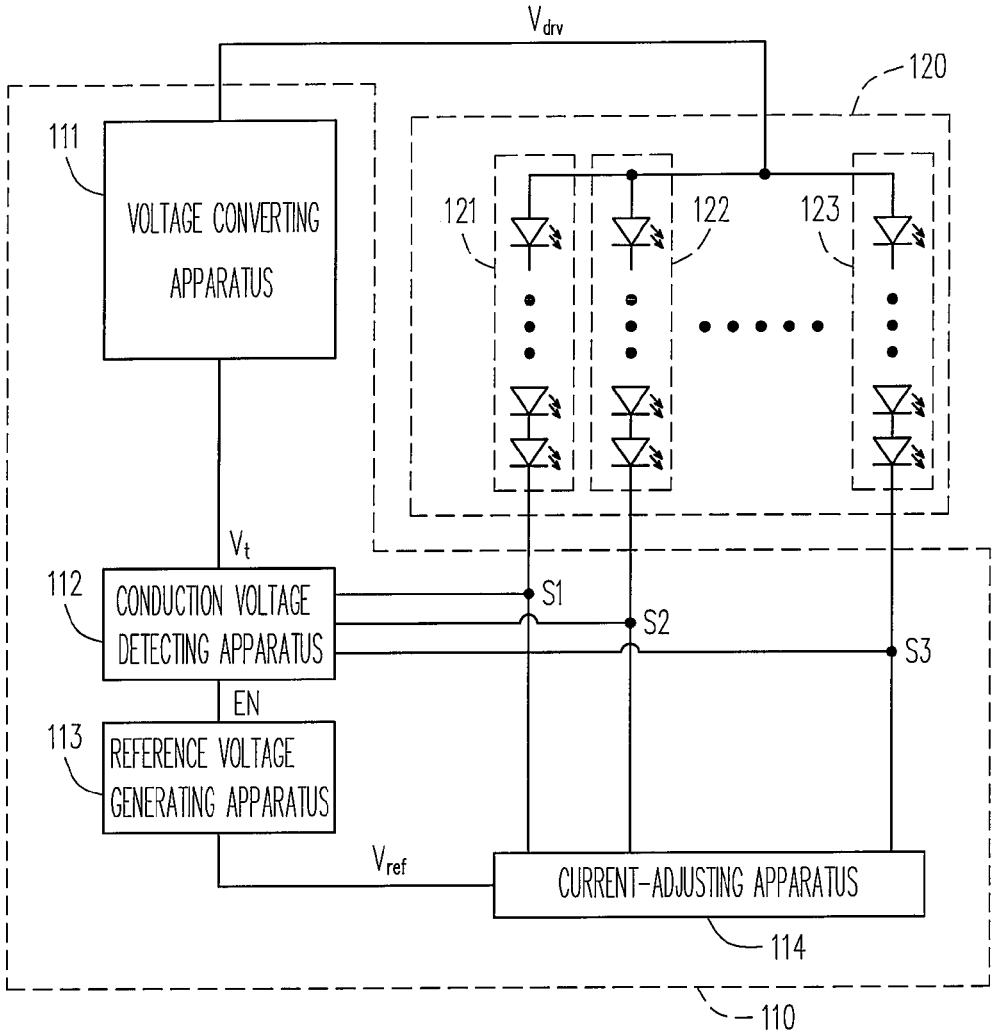
FIG. 1 is a circuit diagram of an LED driving module according to the first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The First Embodiment

FIG. 1 is a circuit diagram of an LED driving module according to the first embodiment of the present invention. Referring to FIG. 1, the LED driving module 110 is for driving a plurality of LED strings 120 in parallel connection. The LED driving module 110 includes a voltage converting apparatus 111, a conduction voltage detecting apparatus 112, a reference voltage generating apparatus 113 and a current-adjusting apparatus 114.

The voltage converting apparatus 111 is for producing driving voltages $V_{drv}$ of a set of LED strings 120 consisted of LED strings 121-123. Usually, the voltage converting apparatus 111 can be implemented by a DC-to-DC converter based on voltage-boosting or a charge pump. No matter which of the above-mentioned circuit is used, the voltage converting apparatus 111 needs to uses a feedback voltage $V_t$ as a reference voltage for voltage-boosting. The driving voltage $V_{drv}$ is a multiple of the feedback voltage $V_t$ (the multiple herein is not necessarily an integer number). Regarding producing the feedback voltage $V_t$, the following depiction of the conduction voltage detecting apparatus 112 would explain it further.

In the first embodiment, the conduction voltage detecting apparatus 112 is coupled to the second terminals S1-S3 of the LED strings 121-123 so as to measure the voltages at the second terminals S1-S3. The conduction voltage detecting apparatus 112 uses the received voltages at the second terminals S1-S3 of the LED strings 121-123 for detecting any LED string in open-loop state (open-loop is produced by probably burning out or removing away). Then, the conduction voltage detecting apparatus 112 selects the minimal voltage among the voltages at the second terminals S1-S3 of the LED strings excluding the LED string in open-loop state and outputs the selected one as the feedback voltage $V_t$.

It can be seen from the described above, the driving voltage $V_{drv}$ is a multiple of the feedback voltage $V_t$; therefore, the driving voltage $V_{drv}$ produced by the voltage converting apparatus 111 at the time should be the minimal required voltage. That is to say, the voltage converting apparatus 111 functions to provide a most effective driving voltage $V_{drv}$.

In addition, the conduction voltage detecting apparatus 112 would send an enabling signal EN reflecting the conducting states of the LED strings 121-123 to the reference voltage generating apparatus 113. The function and operation of the reference voltage generating apparatus 113 are explained in follows.

The reference voltage generating apparatus 113 uses the received enabling signal EN to obtain the number of the LED strings in conducting state in the present set of LED strings 120. The reference voltage generating apparatus 113 produces a reference voltage $V_{ref}$ according to the above-mentioned number, wherein the operation is mainly in response to that when more LED strings get conductive, a larger driving circuit is needed, thus the reference voltage $V_{ref}$ must be accordingly increased; in contrast, when more LED strings are in open-loop state, a less driving voltage is needed and the reference voltage $V_{ref}$ must be accordingly decreased.

The current-adjusting apparatus 114 outputs a driving current in response to the reference voltage $V_{ref}$. In this way, the driving current output from the current-adjusting apparatus 114 is not fixed, so that when an LED string is in open-loop state, the luminance variation due to increasing currents flowing through the rest LED strings can be avoided. In addition, the undesired power consumption can be avoided as well.

The operation of the conduction voltage detecting apparatus 112 can be depicted in more detail in association with an implement of the conduction voltage detecting apparatus 112 according to the first embodiment of the present invention.

Figure 2:
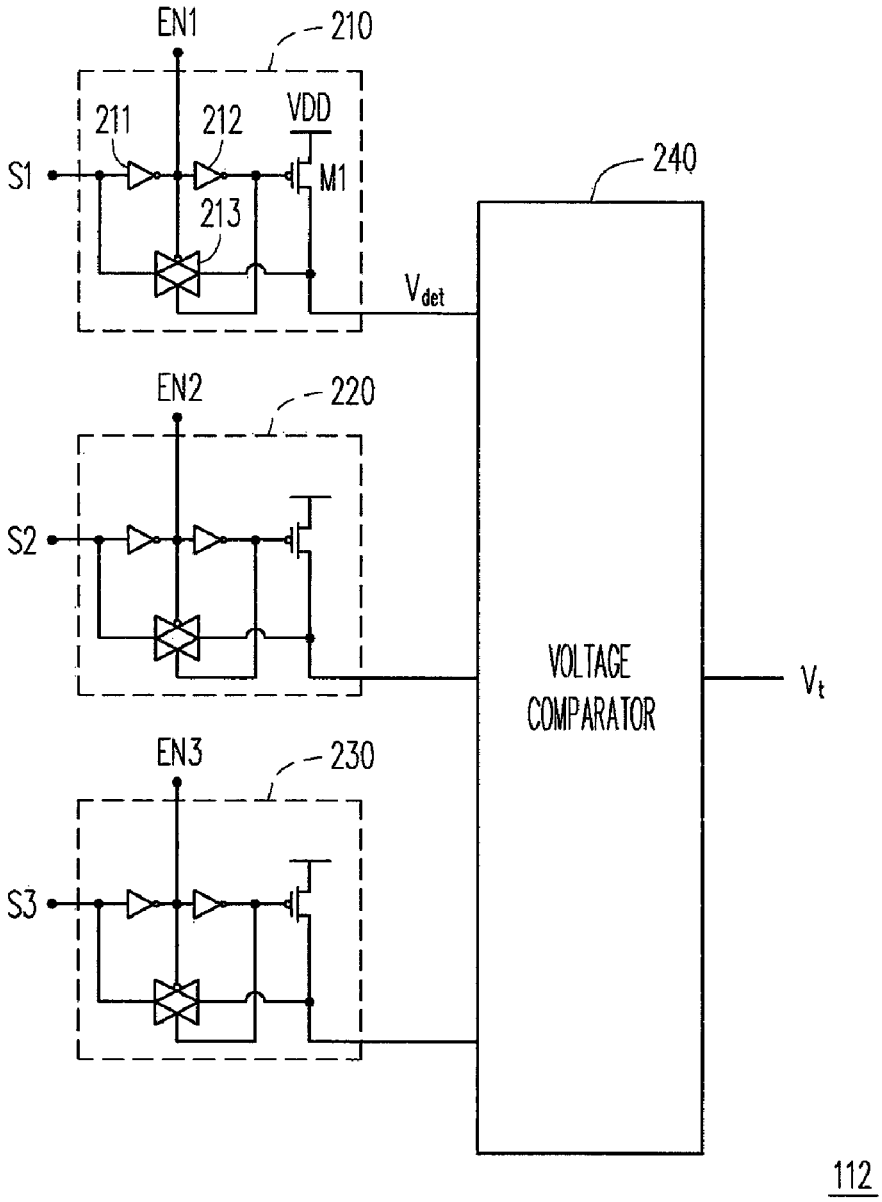
FIG. 2 is a circuit diagram for implementing the conduction voltage detecting apparatus according to the first embodiment of the present invention.

FIG. 2 is a circuit diagram for implementing the conduction voltage detecting apparatus according to the first embodiment of the present invention. Referring to FIG. 2, the conduction voltage detecting apparatus 112 includes conduction voltage detectors 210-230 and a voltage comparator 240, wherein the conduction voltage detectors 210-230 are respectively coupled to the second terminals S1-S3 of the LED strings 121-123.

The conduction voltage detector 210 includes NOT-gates 211-212, a transmission-gate 213 and a transistor M1, wherein the input terminal of the NOT-gate 211 is coupled to the second terminal S1 of the LED string 121 and an enabling signal EN1 is produced at the output terminal of the NOT-gate 211. The input terminal of the NOT-gate 212 is coupled to the output terminal of the NOT-gate 211, which is coupled to the gate of the transistor M1. The first source/drain of the transistor M1 is coupled to the system voltage VDD and the second source/drain thereof produces a detection voltage $V_{det}$. In addition, two enabling terminals of the transmission-gate 213 are respectively coupled to the input terminal and the output terminal of the NOT-gate 212; two data terminals of the transmission-gate 213 are respectively coupled to the input terminal of the NOT-gate 211 and the second source/drain of the transistor M1.

When an LED string is in open-loop state (for example, the LED string 121 is in open-loop state), the voltage at the second terminal S2 approaches the grounded voltage (i.e., usually, 0 V). Meanwhile, the NOT-gate 211 outputs a logic high-level voltage (enabling signal EN1) and the NOT-gate 212 outputs a logic low-level voltage. The transistor M1 in the embodiment is a P-type metal-oxide-semiconductor field-effect transistor (P-MOSFET); therefore, when the transistor M1 is turned on, the second source/drain thereof produces a detection voltage $V_{det}$ almost equal to the system voltage VDD.

In contrast, if the LED string 121 is not in open-loop state, the NOT-gate 211 would output the enabling signal EN and the enabling signal EN is the logic low-level voltage; meanwhile, the NOT-gate 212 would output the logic high-level voltage. At the time, the transistor M1 is turned off and the second source/drain thereof produces the detection voltage $V_{det}$ almost equal to the voltage at the second terminal S2 of the LED string 121. In summary, when an LED string is in open-loop state, the corresponding conduction voltage detector outputs a detection voltage $V_{det}$ and the detection voltage $V_{det}$ must be higher than the detection voltage $V_{det}$ output from the conduction voltage detectors corresponding to the LED string in conducting state.

The wirings and the operations of the conduction voltage detectors 210-230 are the same as the conduction voltage detector 210 and they are omitted to describe.

At the time, the voltage comparator 240 is able to compare the detection voltages produced by the conduction voltage detectors 210-230 with each other and select the minimal detection voltage as the conduction voltage $V_t$ provided to the voltage converting apparatus 111 for use.

Figure 3:
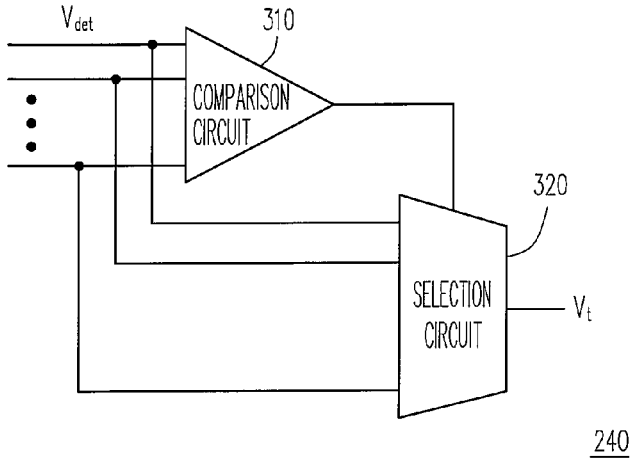
FIG. 3 is a circuit diagram for implementing the voltage comparator 240 according to the first embodiment of the present invention.

FIG. 3 is a circuit diagram for implementing the voltage comparator 240 according to the first embodiment of the present invention. Referring to FIG. 3, the voltage comparator 240 herein includes a comparison circuit 310 and a selection circuit 320, wherein the comparison circuit 310 compares the received detection voltages $V_{det}$ with each other so that the selection circuit selects the minimal voltage to produce a conduction voltage $V_t$.

Figure 4:
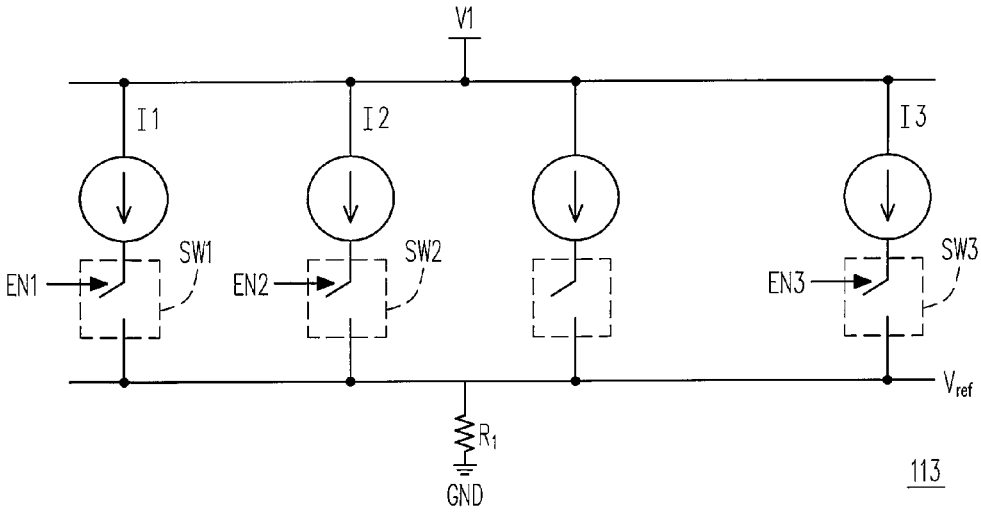
FIG. 4 is a circuit diagram of a reference voltage generating apparatus according to the first embodiment of the present invention.

FIG. 4 is a circuit diagram of a reference voltage generating apparatus according to the first embodiment of the present invention. Referring to FIG. 4, the reference voltage generating apparatus 113 includes current sources I1-I3, switches SW1-SW3 and a resistor R1. The current sources I1-I3 are together coupled to a first voltage V1 and the other terminals of the current sources I1-I3 are respectively coupled to the switches. The switches SW1-SW3 are respectively controlled by enabling terminals EN1-EN3, and the other terminal of the switches SW1-SW3 are together coupled to the resistor R1. Another end of the resistor R1 is coupled to the grounded voltage GND.

When an LED string is turned on, the enabling signal produced by the corresponding conduction voltage detector would enable a corresponding switch, so that a current source connected in series to the switch outputs a current flowing through the resistor R1. Thus, the more the LED strings are turned on, the larger current flows through the resistor R1. Note that the reference voltage $V_{ref}$ is equal to the voltage across both ends of the resistor R1; therefore, the more the LED string are turned on, a higher reference voltage $V_{ref}$ is established.

On the other hand, when an LED string is in open-loop state, the real driving current flowing through the set of LED strings 120 is reduced. For example, if the set of LED strings 120 has eight LED strings and assuming the current required by each LED string is the same $I_d$, the maximal driving current required by the set of LED strings 120 would be equal to $8\times I_d$. Once one of the LED strings is burned out and in open-loop state, the driving current required by the set of LED strings would be $7\times I_d$. It can be seen from the described above, the driving current needs to be further adjusted through dynamically adjusting the reference voltage $V_{ref}$ which is the base for producing the driving current.

A plurality of implements for the current-adjusting apparatus in charge of adjusting currents is depicted as follows, wherein the method for adjusting a driving current can be understood more clearly.

Figure 5A:
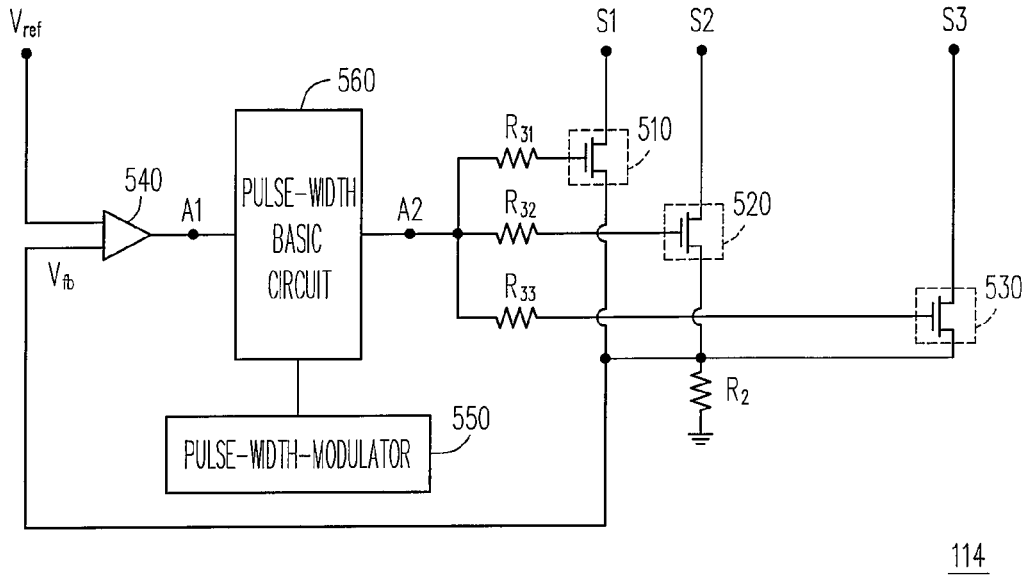
FIG. 5A is a circuit diagram for implementing a current-adjusting apparatus according to the first embodiment of the present invention.

FIG. 5A is a circuit diagram for implementing a current-adjusting apparatus according to the first embodiment of the present invention. Referring to FIG. 5A, the current-adjusting apparatus 114 includes driving current sources 510-530, a resistor R2, an amplifier 540, a pulse-width-modulator (PWM) 550 and a pulse-width basic circuit 560. Three resistors R31-R33 in series connection are respectively disposed between the pulse-width basic circuit 560 and each of the driving current sources 510-530.

The amplifier 540 compares the reduced voltage $V_{fb}$ formed at an end of the resistor R2 with the reference voltage $V_{ref}$ and produces a control voltage for controlling the driving current sources 510-530. In order to make the LED strings provide different luminance corresponding to a certain gray level on a display panel, the PWM 550 and the pulse-width basic circuit 560 are used to convert the voltage at the output terminal A1 of the amplifier 540 into a periodic signal. The ratio of positive pulse over entire period of the periodic signal is corresponding to a certain gray level on the display panel.

To produce the above-mentioned gray level, the driving current sources 510-530 would be switched continuously, which would result in electromagnetic interference (EMI). To overcome the EMI problem, three resistors R31-R33 are respectively connected in series between the output terminal A2 of the pulse-width basic circuit 560 and each of the driving current sources 510-530, wherein the resistors R31-R33 have different resistances, so that the time point for disabling or enabling each the driving current source can be effectively delayed and thereby the EMI can be effectively reduced.

Figure 5B:
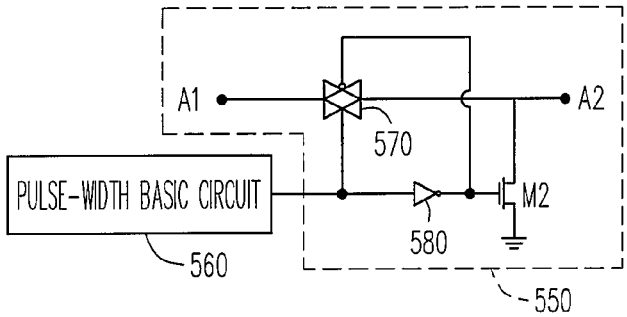
FIG. 5B is a circuit diagram for implementing a pulse-width basic circuit according to the first embodiment of the present invention.

FIG. 5B is a circuit diagram for implementing a pulse-width basic circuit according to the first embodiment of the present invention. Referring to FIG. 5B, the pulse-width basic circuit 560 includes a transmission-gate 570, a NOT-gate 580 and a transistor M2. The input terminal of the transmission-gate 570 is coupled to the output terminal A1 of the amplifier 540. The output terminal of the transmission-gate 570 is coupled to the output terminal A2 of the pulse-width basic circuit 560. The transmission-gate 570 is controlled by the PWM signal produced by the PWM 550. When the transmission-gate 570 is turned on according to the PWM signal, the voltage at the output terminal A1 of the amplifier 540 would effectively enable the driving current sources 510-530 and turn on the set of LED strings 120.

On the contrast, when the transmission-gate 570 is turned off according to the PWM signal, the voltage at the output terminal A1 of the amplifier 540 is unable to be smoothly delivered to the driving current sources 510-530, and the output terminal of the transmission-gate 570 outputs the grounded voltage due to the turned on transistor M2. Then, the driving current sources 510-530 are disabled and the set of LED strings 120 is turned off. In summary, the PWM 550 uses the duty cycle of the produced PWM signal for controlling the luminance of the set of LED strings 120 corresponding to a gray level of the display panel.

Figure 5C:
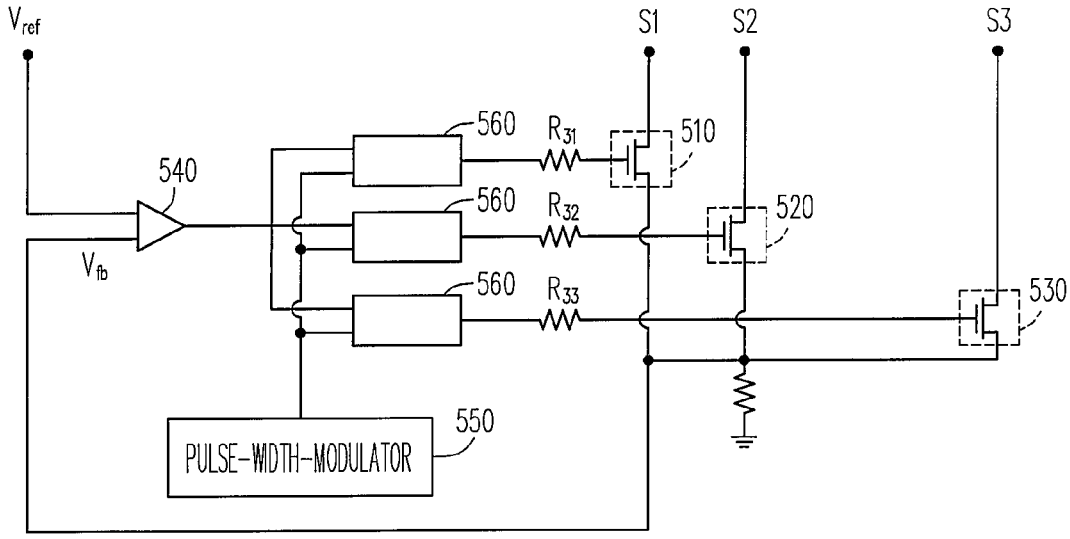
FIG. 5C is a circuit diagram for implementing a current-adjusting apparatus according to the first embodiment of the present invention.

FIG. 5C is a circuit diagram for implementing a current-adjusting apparatus according to the first embodiment of the present invention. Differentially from the previous implement, a plurality of pulse-width basic circuits 550 is used herein to respectively control the luminance of the LED strings 121-123 for different gray levels of the display panel.

The Second Embodiment

The present invention also provides the second embodiment for anyone skilled in the art to further understand the spirit of the present invention.

Figure 6:
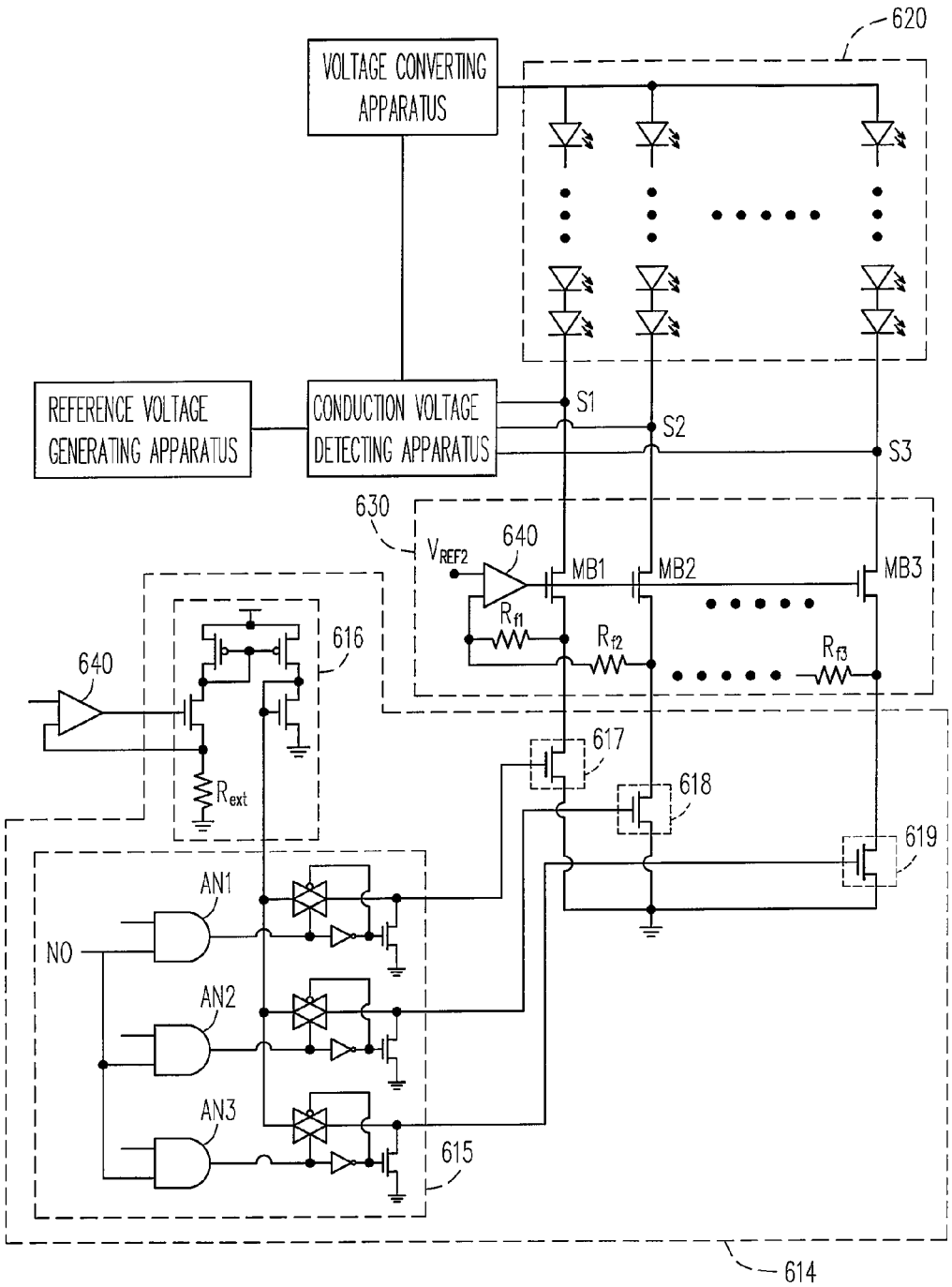
FIG. 6 is a circuit diagram of an LED driving module according to the second embodiment of the present invention.

FIG. 6 is a circuit diagram of an LED driving module according to the second embodiment of the present invention. Referring to FIG. 6, differentially from the first embodiment, in the second embodiment, an additional current-balancing device 630 is employed and the implement of the current-adjusting apparatus 614 is also modified from that of the first embodiment.

In terms of the implement of the current-adjusting apparatus 614, to avoid the driving current sources of the set of LED strings 620 from directly outputting a large driving current, the second embodiment uses a scheme of amplifying current stage by stage. That is, the current amplifier 616 produces a basic current according to the voltage at the positive terminal of the amplifier 640, wherein the basic current can be also adjusted by an adjustable resistor $R_{ext}$. The current amplifier 616 amplifies the basic current and produces an amplified current at the output terminal thereof. The driving current sources 616-619 produce a driving current by mirroring the amplified current.

In addition, AND-gates AN1-AN3 are added in the pulse-width basic circuit 615. The AND-gates AN1-AN3 together receive an enabling signal NO so as to provide a path for entirely turning off the set of LED strings 620 (when the enabling signal NO takes the logic low-level voltage).

A more essential point is to employ a current-balancing device 630 connected in series onto the conduction path of the driving currents for balancing the driving currents and reducing the difference between the driving currents. The current-balancing device 630 includes an amplifier 631, transistors MB1-MB3 and feedback resistor $R_{f1}$-$R_{f3}$. When the set of LED strings 620 produces a voltage difference ΔV between the different second terminals S1-S3 of the LED strings due to a time factor or a temperature variation, the voltage difference ΔV would cause a driving current error.

Assuming the drain voltages at the transistors MB1 and MB2 have a variation and are expressed by the following equation (1):

$$V'_{D,MB1} = V_{D,MB1} + \frac{\Delta V}{2} \qquad (1)$$

$$V'_{D,MB2} = V_{D,MB2} + \frac{\Delta V}{2}$$

wherein $V_{D,MB1}$ and $V_{D,MB1}$ respectively represent the drain voltages of the transistors MB1 and MB2 prior to having a variation; $V'_{D,MB1}$ and $V'_{D,MB1}$ respectively represent the drain voltages of the transistors MB1 and MB2 after having a variation.

In addition, it is assumed there is a micro-current $I_R$ flows through the feedback resistors $R_{f1}$ and $R_{f2}$ and the resistances of the two resistors are the same, R. The source voltages of the transistors MB1 and MB2 can be expressed by the following equation (2):

$$V'_{S,MB1}=V_{S,MB1}+I_R\times R \text{ and } V'_{S,MB2}=V_{S,MB2}-I_R\times R$$

wherein $V_{S,MB1}$ and $V_{S,MB2}$ respectively represent the source voltages of the transistors MB1 and MB2 prior to having a variation; $V'_{S,MB1}$ and $V'_{S,MB1}$ respectively represent the source voltages of the transistors MB1 and MB2 after having a variation The currents produced by the transistors MB1 and MB2 working within the saturation regions thereof are expressed in the following equation (3):

$$I_{LED1} = k[V_G - (V_{REF2} + I_R R) - V_{to}]^2 \left\{1 + \lambda\left[V_{D,MB1} + \frac{\Delta V}{2} - (V_{REF2} + I_R R)\right]\right\} = I_{sink1} + I_R \qquad (3)$$

$$I_{LED2} = k[V_G - (V_{REF2} + I_R R) - V_{to}]^2 \left\{1 + \lambda\left[V_{D,MB2} + \frac{\Delta V}{2} - (V_{REF2} + I_R R)\right]\right\} = I_{sink2} + I_R$$

wherein $I_{LED1}$ and $I_{LED2}$ respectively represent the currents flowing through two LED strings, $V_G$ represents the voltage at the output terminal of the amplifier 631, $V_{ref}$ represents the reference voltage received by the amplifier 631, $V_t$ represents the conduction voltage, $I_{sink1}$ and $I_{sink2}$ represent the driving currents produced by the driving current sources 617 and 618, and k and λ represent constants.

The current difference between the two LED strings and the average value thereof can be expressed by the following equations (4) and (5):

$$I_{LED1}-I_{LED2}=k(V_{GS}-V_{TO})^2\lambda(2I_R R)+2I_R \qquad (4)$$

$$(I_{LED1}+I_{LED2})/2=k(V_{GS}-V_{TO})^2(1+\lambda V_{REF2}) \qquad (5)$$

wherein $V_{GS}$ is the voltage difference between the gate and the source of the driving current sources 617 and 618, and $V_{REF}$ is the second reference voltage $V_{REF}$.

The equation (5) divides the equation (4), the current variation between the two LED strings is obtained as the following equation (6):

$$\delta=2\lambda I_R R \qquad (6)$$

Since the feedback resistors $R_{f1}$ and $R_{f2}$ are disposed on the negative feedback path and one of the ends is coupled to the input terminal with a high impedance of the amplifier 631; therefore, only a tiny current (a level of μA) flows through the feedback resistors $R_{f1}$ and $R_{f2}$, and the voltage difference between the two ends is also subject to the negative feedback characteristic so that the voltage drop caused by the negative feedback takes also a tiny level of mV. The constant λ is a channel-length modulation parameter, roughly equal to 10 mV. Under the above-mentioned architecture, the current error between the two LED strings is estimated as $10^{-2}$% according to the equation (6).

In summary, the present invention uses a conduction voltage detecting apparatus for detecting the number of the LED strings in open-loop state, and thereby adjusts the driving voltage and the driving current so as to reduce unnecessary power consumption. the present invention further uses a current-balancing device to effectively reduce the current error between each of the LED strings. As a result, the set of LED strings provided by the present invention has good luminance uniformity.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A light emitting diode driving module, suitable to drive a plurality of light emitting diode strings in parallel connection, wherein each of the light emitting diode strings has a first terminal and a second terminal; the light emitting diode driving module comprising:

a voltage converting apparatus, for producing a driving voltage at the first terminal of each light emitting diode string according to a conduction voltage;

a conduction voltage detecting apparatus, coupled to the second terminal of each light emitting diode string for detecting the conducting states of the light emitting diode strings to generate a plurality of enabling signals and producing the conduction voltage according to the enabling signals;

a reference voltage generating apparatus, for generating a first reference voltage according to the enabling signals; and a current-adjusting apparatus, for producing a plurality of driving currents respectively flowing through each light emitting diode string according to the first reference voltage.

2. The light emitting diode driving module according to claim 1, wherein the conduction voltage detecting apparatus comprises:

a plurality of conduction voltage detectors, respectively coupled to the second terminal of each the light emitting diode string for respectively producing a plurality of detection voltages according to the conducting states of the light emitting diode strings; and a voltage comparator, for comparing the detection voltages with each other and selecting the minimal voltage among the detection voltages as the conduction voltage.

3. The light emitting diode driving module according to claim 2, wherein each of the conduction voltage detectors comprises:

a first NOT-gate, having an input terminal and an output terminal, wherein the input terminal is coupled to the second terminal of each light emitting diode string and the output terminal thereof produces one of the enabling signals;

a second NOT-gate, having an input terminal coupled to the output terminal of the first NOT-gate;

a first transistor, having a gate, a first source/drain and a second source/drain, wherein the gate is coupled to the output terminal of the second NOT-gate and the first source/drain is coupled to the system voltage; and a first transmission-gate, having a first enabling terminal, a second enabling terminal, a first data terminal and a second data terminal, wherein the first enabling terminal is coupled to the output terminal of the first NOT-gate, the second enabling terminal is coupled to the output terminal of the second NOT-gate, the first data terminal is coupled to the input terminal of the first NOT-gate, the second data terminal is coupled to the second source/drain of the first transistor and the second data terminal of the first transmission-gate transmits one of the detection voltages.

4. The light emitting diode driving module according to claim 2, wherein the voltage comparator comprises:

a comparison circuit, for receiving the detection voltages, comparing the detection voltages with each other and producing a selection signal according to the comparison result of the detection voltages; and a selection circuit, for selecting the minimal voltage among the detection voltages as the conduction voltage according to the selection signal.

5. The light emitting diode driving module according to claim 1, wherein the reference voltage generating apparatus comprises:

a plurality of current sources, together coupled to a first voltage;

a plurality of switches, respectively having a first terminal, a second terminal and an enabling terminal, wherein the first terminal is respectively connected in series to each of the current sources and the enabling terminal of each switch is coupled to each enabling signal; and a first resistor, having a first end and a second end, wherein the first end of the first resistor is commonly coupled to the second terminals of all the switches and the second end thereof is coupled to a grounded voltage;

wherein the enabling signals adjust the current flowing through the first resistor and further adjust the first reference voltage through disabling/enabling the current sources.

6. The light emitting diode driving module according to claim 1, wherein the current-adjusting apparatus comprises:

a plurality of first driving current sources, respectively having a first terminal, a second terminal and a control terminal, wherein the first terminals of the first driving current sources are respectively coupled to the second terminals of the light emitting diode strings for producing the driving currents;

a second resistor, having an end coupled to the grounded voltage and the other end commonly coupled to the second terminals of the first driving current sources; and a first amplifier, having a first input terminal, a second input terminal and an output terminal, wherein the first input terminal receives the first reference voltage, the second input terminal is commonly coupled to the second terminals of the first driving current sources, and the output terminal thereof is commonly coupled to the control terminals of the first driving current sources for controlling the currents of the driving currents.

7. The light emitting diode driving module according to claim 6, wherein the current-adjusting apparatus further comprises:

a first pulse-width-modulator, for producing a first pulse-width-modulated signal at the first enabling terminal of the second transmission-gate; and a first pulse-width basic circuit, connected in series between the output terminal of the first amplifier and the control terminals of the first driving current sources for enabling or disabling the first driving current sources.

8. The light emitting diode driving module according to claim 7, wherein the first pulse-width basic circuit comprises:

a second transmission-gate, having an input terminal, an output terminal, a first enabling terminal and a second enabling terminal, wherein the input terminal is coupled to the output terminal of the first amplifier and the output terminal thereof is coupled to the control terminals of the first driving current sources for controlling the driving currents;

a third NOT-gate, having an input terminal and an output terminal, wherein the input terminal receives the first pulse-width-modulated signal and the output terminal thereof is coupled to the second enabling terminal of the second transmission-gate; and a second transistor, having a gate, a first source/drain and a second source/drain, wherein the gate is coupled to the output terminal of the third NOT-gate, the first source/drain thereof is coupled to the output terminal of the second transmission-gate and the second source/drain thereof is coupled to the grounded voltage.

9. The light emitting diode driving module according to claim 7, further comprising a plurality of second resistors in series connection onto the connection path between the first pulse-width basic circuit and the first driving current sources for delaying the disabling time or the enabling time of the first driving current sources.

10. The light emitting diode driving module according to claim 6, wherein the current-adjusting apparatus further comprises:

a second pulse-width-modulator, for producing a plurality of second pulse-width-modulated signals; and a plurality of second pulse-width basic circuits, respectively connected in series between the output terminal of the first amplifier and the control terminal of each of the first driving current sources for respectively disabling or enabling the first driving current sources according to the second pulse-width-modulated signals.

11. The light emitting diode driving module according to claim 10, wherein each of the second pulse-width basic circuits comprises:

a third transmission-gate, having an input terminal, an output terminal, a first enabling terminal and a second enabling terminal, wherein the first enabling terminal receives one of the second pulse-width-modulated signals, the input terminal is coupled to the output terminal of the first amplifier and the output terminal thereof is respectively coupled to the control terminals of the first driving current sources for controlling the driving currents;

a fourth NOT-gate, having an input terminal and an output terminal, wherein the input terminal is coupled to the first enabling terminal of the third transmission-gate and the output terminal thereof is coupled to the second enabling terminal of the third transmission-gate; and a third transistor, having a gate, a first source/drain and a second source/drain, wherein the gate is coupled to the output terminal of the fourth NOT-gate, the first source/drain thereof is coupled to the output terminal of the third transmission-gate and the second source/drain thereof is coupled to the grounded voltage.

12. The light emitting diode driving module according to claim 11, wherein each of the second pulse-width basic circuits further comprises:

an AND-gates, connected in series onto a connection path, through which the first enabling terminal of the third transmission-gate receives one of the second pulse-width-modulated signals, having a first input terminal, a second input terminal and an output terminal, wherein the first input terminal receives one of the second pulse-width-modulated signals, the second input terminal receives a starting signal and the output terminal is coupled to the first enabling terminal of the third transmission-gate.

13. The light emitting diode driving module according to claim 10, further comprising a plurality of third resistors connected in series onto the connection path between the second pulse-width basic circuits and the second driving current sources for delaying the disabling time or the enabling time of the second driving current sources.

14. The light emitting diode driving module according to claim 6, wherein the current-adjusting apparatus further comprises:

a current amplifier, connected in series onto the connection path between the first amplifier and the first driving current source, having an output terminal, wherein the current amplifier produces a basic current according to the voltage at the output terminal of the first amplifier, amplifies the basic current and produces an amplified current at the output terminal of the current amplifier.

15. The light emitting diode driving module according to claim 14, wherein the current amplifier comprises:

a fourth transistor, having a gate, a first source/drain and a second source/drain, wherein the first source/drain is coupled to the system voltage and the gate is coupled to the second source/drain;

a fifth transistor, having a gate, a first source/drain and a second source/drain, wherein, the gate is coupled to the gate of the fourth transistor and the first source/drain thereof is coupled to the system voltage;

a sixth transistor, having a gate, a first source/drain and a second source/drain, wherein the gate is coupled to the output terminal of the first amplifier, the first source/drain is coupled to the second source/drain of the fourth transistor and the second source/drain is coupled to the second input terminal of the first amplifier;

a seventh transistor, having a gate, a first source/drain and a second source/drain, wherein the gate and the first source/drain of the seventh transistor are coupled to the second source/drain of the fifth transistor, and the second source/drain of the seventh transistor is coupled to the grounded voltage; and an adjustable resistor, connected in series between the second source/drain of the sixth transistor and the grounded voltage.

16. The light emitting diode driving module according to claim 1, further comprising:

a current-balancing device connected in series onto the connection paths of the driving currents for receiving and balancing the driving currents and thereby reducing the differences between the driving currents.

17. The light emitting diode driving module according to claim 16, wherein the current-balancing device comprises:

a second amplifier, having a first input terminal, a second input terminal and an output terminal, wherein the first input terminal receives a second reference voltage;

a plurality of eighth transistors, respectively having a gate, a first source/drain and a second source/drain, wherein the gate of each eighth transistor is coupled to the output terminal of the second amplifier and the first source/drain receives one of the driving currents; and a plurality of feedback resistors, respectively connected in series between the second sources/drains of the fourth transistors and the second input terminal of the second amplifier.

* * * * *